US006241242B1

(12) United States Patent
Munro

(10) Patent No.: US 6,241,242 B1
(45) Date of Patent: Jun. 5, 2001

(54) DESKEW OF PRINT MEDIA

(75) Inventor: Michael W. Munro, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/416,709

(22) Filed: Oct. 12, 1999

(51) Int. Cl.[7] ..... B65H 9/16
(52) U.S. Cl. ..... 271/252; 271/250; 271/272
(58) Field of Search ..... 271/248, 250, 271/251, 252, 272

(56) References Cited

U.S. PATENT DOCUMENTS 4,836,119 * 6/1989 Siraco et al. ..... 271/251
4,909,500 * 3/1990 Grutzmacher et al. ..... 271/251
5,280,903 * 1/1994 Herrick ..... 271/251
5,449,161 9/1995 Cysling ..... 271/119
5,507,478 4/1996 Nottingham et al. ..... 271/10.02
6,053,494 * 1/2000 Baskette et al. ..... 271/251

FOREIGN PATENT DOCUMENTS

1154964 * 6/1969 (GB) ..... 271/251

* cited by examiner

*Primary Examiner*—H. Grant Skaggs

(57) ABSTRACT

A print media deskew apparatus includes a print media support having a first surface defining a plane for a print media transport path and a second surface parallel to the print media transport path and two apertures in the first surface aligned in the print media transport path. A first set of selectively driven spheres in the print media transport path and a second set of selectively driven spheres in the print media transport path downstream from the first impart a paper path force and a lateral driving force on a media sheet such that the sheet is driven laterally to the print media transport path until edge contact with the second surface removes any skew from the sheet.

29 Claims, 1 Drawing Sheet

DESKEW OF PRINT MEDIA

BACKGROUND OF THE INVENTION

1. Field of the Invention

The present invention relates generally to hard copy apparatus and, more specifically, to a method and apparatus for deskew of a fed sheet using spherical drive mechanisms with independent axial drives.

2. Description of Related Art

It is well known that a cut sheet piece of print media must be appropriately aligned to the associated printing mechanism if a true print of the data or a true copy of a document is to be successfully rendered. Problems associated with the variety of prior art mechanisms—such as spring-loaded side guides and canted rollers used to drive d sheet into and along a side wall—are exacerbated by the fact that it is difficult to tune a hard copy paper transport subsystem to work identically with a broad range of print media weights and sizes available to the end user. Spring-loaded side guides are sensitive to the parallelism of the side edges and the width of the sheet. Side guides do not give predictable alignment or edge position due to the inaccuracy of the paper cutting process. The edges of the sheet will generally not be perfectly parallel. As the side guides are attempting to align on both edges simultaneously, it is unpredictable which edges will end up dominating the alignment. For this same reason, the location of the edge of the sheet is unpredictable. The stiffness of the media being aligned will also vary and in some cases the force imparted by the side guides will cause the edge of the sheet to buckle. In addition to possibly damaging the sheet, this further reduces the predictability of the sheet position and orientation.

Canted rollers may slip on the sheet surface and cause damage to soft-coated media. Media type settings that work well for relatively lightweight media—e.q., plain paper-are often ineffective for relatively heavyweight media—e.g., card stock, letter size envelopes, and overhead transparencies. Settings that work for stiffer media frequently damage relatively flexible media.

There is a need for a deskewing system that works effectively over a broad range of media weights, sizes, and types.

[For convenience of description, print media of all shapes, sizes, and varieties are referred to hereinafter simply as "media," "sheet," or "paper" as best fits the context; no limitation on the scope of the invention is intended by the inventors, nor should any such limitation be implied.]

SUMMARY OF THE INVENTION

In its basic aspects, the present invention provides a print media deskew system for aligning print media to a hard copy producing mechanisms located downstream of the deskew system along a print media transport path. The system includes: guide mechanisms for supporting a print medium, including a base member having support surface for supporting a first surface of the print medium transported through the system, and adjacent the support surface, an abutment for abutting an edge of the print medium transported through the system and for aligning the print medium to the hard copy producing mechanisms, and at least two apertures through the support surface; and located proximate the base member, print medium feeder for transporting the print medium through the system. The feeder includes, located respectively to bridge each of the at least two apertures, at least two paired spherical members for sequentially receiving the print medium by a leading edge between each of the paired spherical members and simultaneously driving the print medium along the transport path 103 across the support surface and driving the print medium laterally to the transport path across the support surface such that the edge of the print medium is driven against the abutment.

In another basic aspect, the present invention provides a method for aligning a sheet of print media in a transport path to a downstream printing station of a hard copy apparatus. The method includes the steps of: providing a fixed abutment having a substantially vertical wall in a plane parallel to the transport path; and driving the sheet along the transport path via spherical contact members contacting both sides of the sheet and imparting therewith both a force in the transport path toward the printing station and a force normal to the transport path such that an edge of the sheet is driven to and along the wall.

In another basic aspect, the present invention provides a print media deskew apparatus, including: a print media support having a first surface defining a plane for a print media transport path and a second surface parallel to the print media transport path and two apertures in the first surface aligned in the print media transport path; and a first set of selectively driven spheres in the print media ransport path and a second set of selectively driven spheres in the print media transport path downstream from the first set, each the set having a drive sphere and a pinch sphere mounted such that the drive sphere and the pinch sphere are in peripheral contact in the plane wherein a sheet of print medium is captured and driven between the drive sphere and the pinch sphere of the first set and second set sequentially as the sheet is transported along the print media transport path and wherein the driven spheres further impart a lateral driving force on the sheet such that the sheet is driven laterally to the print media transport path until edge contact with the second surface removes any skew from the sheet.

Some of the advantage of the present invention are:

- it provides solutions to the problems inherent in the prior art;
- it accommodates transport and alignment a range of print media sizes, preferably without requiring foreknowledge of the size;
- it exerts enough force just to align a sheet, requiring no sliding contact with drive rollers; and
- it can be implemented in an adjustable contact force embodiment.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as riot being drawn to scale except if specifically annotated.

DESCRIPTION OF THE PREFERRED EMBODIMENT

Reference is made now in detail to a specific embodiment of tho present invention, which illustrates the best mode presently contemplated by the inventor for practicing the invention. Alternative embodiments are also briefly described as applicable.

Figure 1:
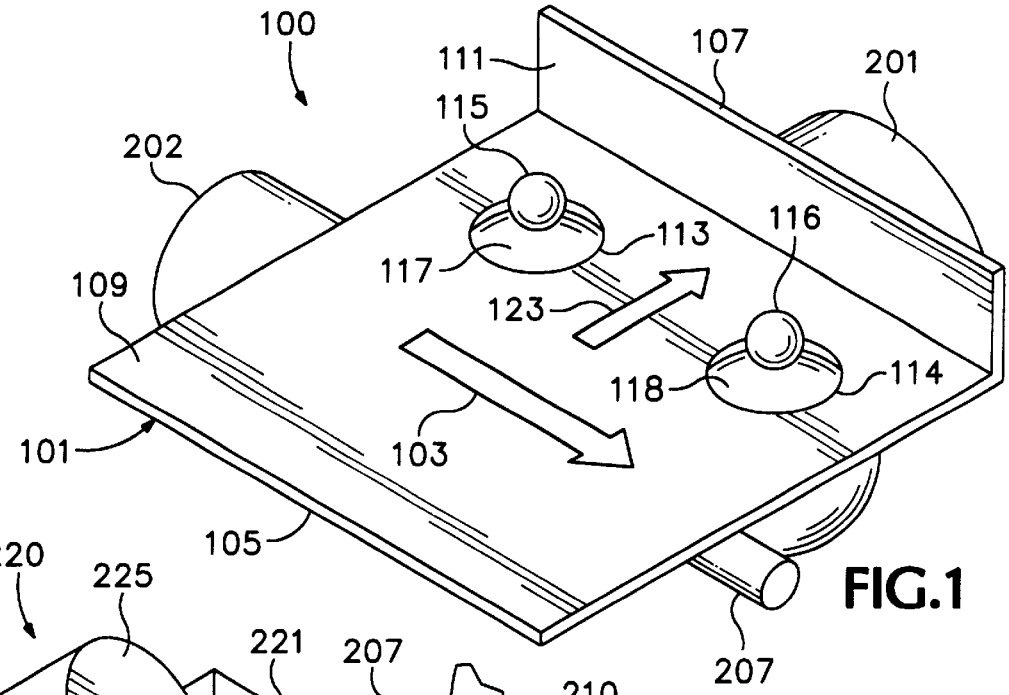
FIG. 1 is a schematic illustration, top angle perspective view angle, of a print media deskew apparatus in accordance with the present invention.

FIG. 1 is a top-angle, isometric view of the deskew system 100 in accordance with the present invention. A paper guide 101 is fixedly mounted in a suitable known manner within a hard copy apparatus in the paper path (demonstrated by arrow 103) upstream of the printing station where a text is to be rendered or an image formed either by a printing apparatus (such as an ink-jet subsystem), a duplicating apparatus (such as a scanner-printer subsystem), or a like hard copy apparatus of the state of the art. The paper guide 101 includes a substantially flat print media support base, or plate, 105 and an upright 107. The support plate 105 has a top surface 109 that supports a sheet as it travels along the paper path 103. The plate top surface 109 meets the upright 107 at a right-angle such that the upright further forms a wall having media guide surface 111 perpendicular to the plate top surface. The upright 107 wall guide surface 111 is parallel to the paper path 103 and, preferably, has a dimension in a plane parallel to the paper path 103 approximately equal to that of the top surface 109 of the plate 105.

There are at least two apertures 113, 114 through the primal media support plate 105. In the preferred embodiment, the two apertures are longitudinally aligned in the paper path 103 direction such that a sheet being transported from a known manner input supply (not shown; e.g., input tray subsystems) to the deskew system 100 by a known manner pick-anid-feed mechanism (see e.g., U.S. Pat. No. 5,449,161, by Gysling for a HARD COPY SHEET MEDIA PICK MECHANISM and U.S. Pat. No. 5,507,478, by Nottingham et al. for PRINTING MEDIA STATUS SENSING (assigned to the common assignee of the present invention and incorporated herein by reference). Aperture alignment in the paper path 103 direction ensures both apertures 113, 114 will be traversed sequentially by a leading edge of a sheet as it travels along the paper path 103.

Figure 2A:
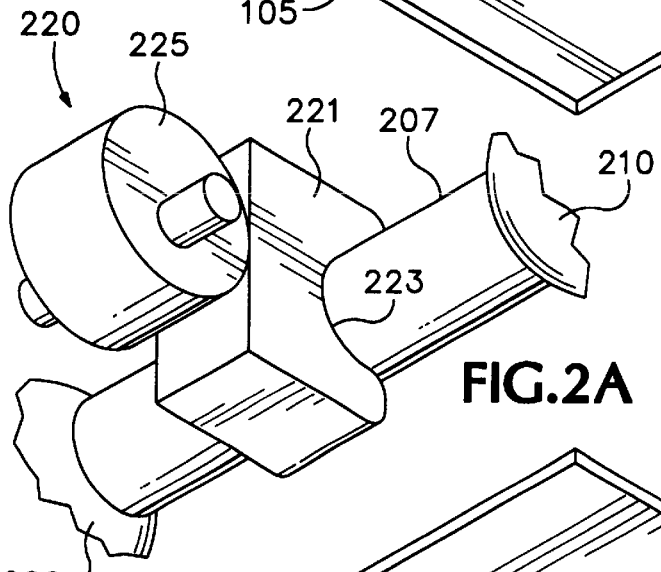
FIG. 2 is a schematic illustration, bottom angle perspective view angle, of detail of print media deskew apparatus in accordance with the present invention as shown in FIG. 2A is a schematic illustration of detail of a camming subsystem in accordance with the present invention as shown in FIG. 2.
Figure 2:
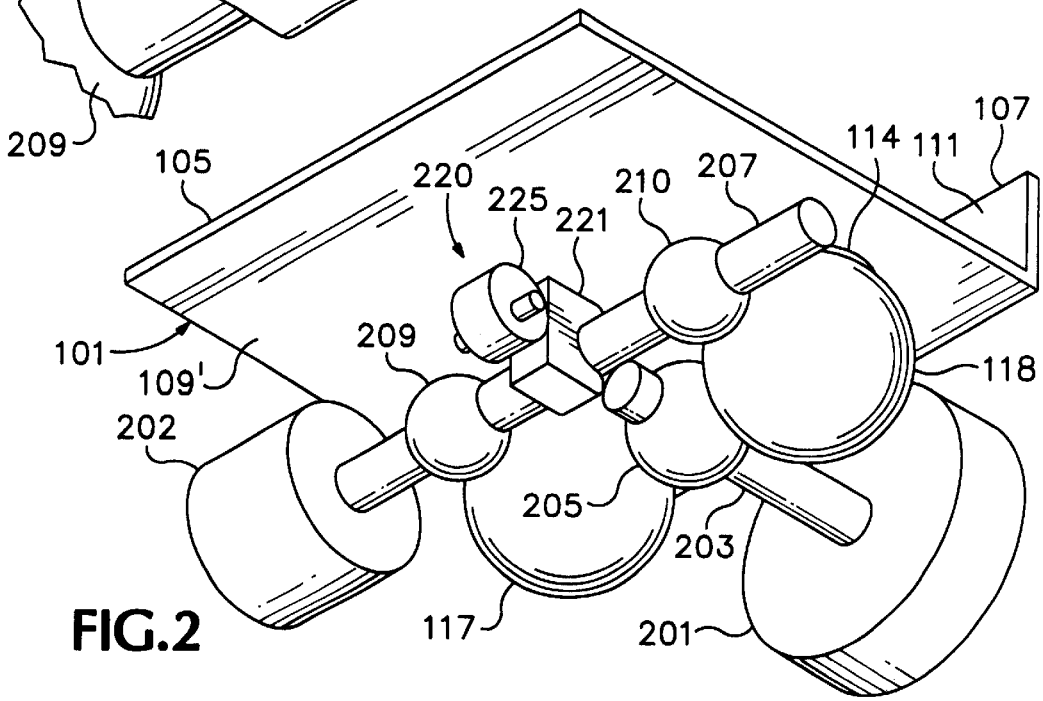

Referring now to both FIG. 1 and FIG. 2, at least two pinch spheres 115, 116 are suitably mounted in a known manner for free rotation in a fixed orientation substantially central to respective apertures 113, 114 of the support plate 105. Each pinch sphere 115, 116 is mounted such that its outer surface will contact one surface of a sheet of paper supported by the plate surface 109 as the sheet is transported along the paper path 103. The pinch spheres 115, 116 are preferably mounted in a conventional manner to float but with a general, known manner, bias toward the plate surface 109. For example, a set of three rollers in contact with the upper hemisphere of the pinch sphere, exerting a downward force determined in accordance with a specific implementation.

As seen in both the Figures, a complementary pair of driving spheres 117, 118, mounted in a freely rotational known manner subjacent the support plate 105 each have their outer surfaces extending through the apertures 113, 114, respectively such that they are in contact with the pinch spheres 115, 116, respectively.

In the preferred embodiment, the drive spheres have a relatively smooth surface that provides a relatively high coefficient of friction with plain paper. In general, the coefficient friction between the coupling spheres and the drive spheres should be less than the coefficient between the drive spheres and the paper such that the drive spheres will slip when the paper edge hits the wall, but not so low that a force sufficient to overcome the sheet's friction with the surfaces it is to slide along cannot be applied.

Thus, a sheet of paper picked and fed along the paper path 103 with have its leading edge captured first between the first sphere set including the paper path upstream pinch sphere 115 and drive sphere 117 arid sequentially thereafter between the second sphere set including the downstream pinch sphere 116 and drive sphere 118. Thus, a sheet of media in the paper path is pinched between the pinch spheres 115, 116 and driving spheres 117, 118, preferably with a force that will not impart any damage to the sheet.

Movement of the spheres 115–118 is controlled by a pair of motors 201, 202. The drive subsystem components are located beneath the bottom surface 109' of the plate 105. [It will be recognized by those skilled in the art that particular implementations may have other orientations; the inventor intends no limitation on the scope of the invention by use of terms like "top" and "bottom" and no such intention should be implied.] The motors 201, 202 are coupled to the spheres 115–118 to impart motion to a sheet on the support plate 105 having both a paper path 103 component force—also referred to as the "longitudinal component" (however, it also will be recognized by those skilled in the art that paper feed orientation is relative to any particular design implementation)—and a lateral component force thereto as represented in FIG. 1 by arrow 123.

The paper path 103 drive longitudinal component is generated by paper path drive motor 201, having a paper path drive shaft 203 (or other known manner motor coupling common to the art) which rotates a paper path drive coupling sphere 205 (FIG. 2 only) located between and in peripheral contact with each of the drive spheres 117, 118, thereby transmitting the rotation of the shaft to the drive spheres. The paper path drive coupling sphere 205 is fixedly mounted on the paper path drive shaft 203. The longitudinal component drive motor 201 thus selectively imparts predetermined longitudinal motion (e.g., continuous or stepping) to the drive spheres 117, 118 via the paper path drive coupling sphere 205.

The paper path drive lateral component 123 is generated by a deskew drive motor 202 having a lateral positioning drive shaft 207 (or other known manner motor coupling common to the art) which rotates a pair of lateral component drive coupling spheres 209, 210.

Slipping will take place at the contact point between the coupling sphere and the drive sphere. As the imparted paper force at which this slipping will take place is a function of both coefficient of friction and the normal force at the contact point between the coupling sphere and the drive sphere, an appropriate choice of materials for a specific implementation and the resulting coefficient of friction should allow the normal force to be varied in such a manner as to give a beneficial range of maximum force impart to the sheet.

In the alternative, the lateral component drive coupling spheres 209, 210 are mounted on the lateral positioning drive shaft 207 in a sliding fit such that a predetermined back pressure on the spheres will cause the spheres to slip on that shaft. The lateral component drive coupling spheres 209, 210 are in peripheral contact with respective drive spheres 117, 118 at a position orthogonally located from the longitudinal drive, paper path drive coupling sphere 205. Thus, the lateral component drive coupling spheres 209, 210 selectively impart predetermined lateral motion to them at any pressure less than the predetermined back pressure. This lateral force 123 serves to bias the side edge of a sheet in the paper path on the plate surface 109 against the wall 111.

Note that the two drive shafts 201 are positioned such that their motions are independent. As a sheet is fed forwards along the paper path 103 by the longitudinal component, it is aligned by driving its side edge in the lateral component 123 direction such that the side edge is flush with the wall 111 and any skew with respect to the longitudinal orientation to the paper path 103 is removed.

An optional component is a lateral force adjusting device 220 detailed in FIG. 2A. A block 221, mounted in any known manner to be positioned selectively with respect to the lateral positioning drive shaft 207, has a curved bearing face 223 to journal the perimeter of the lateral positioning drive shaft. A selectively positionable cam 225 is mounted in any known manner to vary the normal force on the shaft 207 and hence between the lateral component drive coupling spheres 209, 210 and respective drive spheres 117, 118. Varying this normal force will vary the amount of lateral force 123 the drive spheres 117, 118 are able to exert on a sphere-captured sheet in the paper path 103 before slipping begins at the interface between the lateral positioning drive spheres 209, 210 and their drive shaft 207. The normal force is adjustable via the cam 225 and is to be set relatively low for relatively flexible, light weight, media and increased the stiffer the media.

As will be recognized by a person skilled in the art, the cam-type lateral force adjusting device 220 can be replace by other means, such as adding a second lateral axis motor so that the lateral component imparted by each lateral component drive coupling sphere 209, 210 can be driven separately; the motors can be stalled when the desired lateral force 123 is reached.

The distance between the drive spheres tangential contact with a sheet in the paper path 103 is determined by the smallest dimension of print media intended for use with the particular design, e.q., slightly less than 3.5-inches for a 3.5-by-5 inch card stock fed in a landscape orientation to the paper path 103. This allows the system 100 to deskew a wide range of media sizes without foreknowledge of the currently fed media size.

In alternative embodiments for handling more complex media transport needs, a system 100 having a grid of more than the depicted two sets of spheres 115–118 and associated drives can be provided. In other words, the system can have a grid of paired spherical members bridging the apertures and arrayed respectively with respect to a plurality of apertures in the support surface such that the grid has a predetermined pattern associated with a plurality of sizes of print media transported by the system.

It is also envisioned that a curvilinear support plate system can be employed in accordance with the present invention.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A print media deskew system for aligning print media to a hard copy producing means located downstream of the deskew system along a print media transport path, the system comprising:

guide means for supporting a print medium, including a base member having support surface means for supporting a first surface of the print medium transported through the system, and adjacent the support surface means, abutment means for abutting an edge of the print medium transported through the system and for aligning the print medium to the hard copy producing means, and at least two apertures through the support surface means;

located proximate the base member, print medium feed means for transporting the print medium through the system, the feed means including, located respectively to bridge each of the at least two apertures, at least two paired spherical members for sequentially receiving the print medium by a leading edge between each of the paired spherical members and simultaneously driving the print medium along the transport path across the support surface means and driving the print medium laterally to the transport path across the support surface means such that the edge of the print medium is driven against the abutment means, each set of paired spherical members including a pinch sphere located superjacent one of the apertures and a drive sphere located subjacent one of the apertures such that the pinch sphere and drive sphere of a set are in peripheral contact at a predetermined pressure for receiving and driving the print medium there between; and transport path drive motor having a first drive shaft coupled to each drive sphere of each set of paired spherical members for simultaneously imparting motion to each drive sphere to impart a drive force longitudinally in the transport path.

2. The system as set forth in claim 1, the feed means further comprising:

means for adjusting lateral forces exerted on the print medium.

3. The system as set forth in claim 1, comprising:

the at least two apertures are offset in a transport path axis.

4. The system as set forth in claim 1, comprising:

the at least two apertures are axially aligned with the transport path.

5. The system as set forth in claim 1, comprising:

a grid of paired spherical members arrayed respectively with respect to a plurality of apertures in the support surface means such that the grid has a predetermined pattern associated with a plurality of sizes of print media transported by the system.

6. The system as set forth in claim 1, comprising:

the predetermined pressure is a function of a first coefficient of friction between each pinch sphere and drive sphere respectively wherein the first coefficient is less than a second coefficient of friction between each drive sphere and the print medium respectively such that the drive sphere will slip when a print medium edge hits the abutment means, but not so low as not to overcome the print medium friction with the support surface means.

7. The system as set forth in claim 1, comprising:

the first shaft is coupled to each drive sphere via a transmission sphere fixedly mounted on the first shaft and peripherally in contact with each drive sphere.

8. The system as set forth in claim 1, comprising:

a deskew drive motor having a second drive shaft coupled to each drive sphere of each set of paired spherical members for simultaneously imparting motion to each drive sphere to impart a drive laterally to the transport path.

9. The system as set forth in claim 8, comprising:

the second drive shaft is coupled to each drive sphere via an adjacently located lateral positioning drive spheres slip mounted on the second drive shaft and respectively peripherally in contact with each drive sphere such that lateral positioning force is imparted to each the drive sphere at any pressure less than the predetermined back pressure which will cause the contact to slip.

10. The system as set forth in claim 9, the means for adjusting lateral forces comprising:

means for exerting a lateral force on the second drive shaft in the direction of the abutment means, and means for adjusting the lateral force such that the lateral force serves to bias the side edge of a sheet in the paper path on the plate surface at selective levels associated with predetermined media thicknesses.

11. The system set forth in claim 10, the means for adjusting lateral forces comprising:

a camming device for setting a lateral pressure against the second drive shaft such that selectively changing the lateral pressure against the second drive shaft imparts variable lateral pressure to the lateral positioning drive spheres.

12. A print media deskew system for aligning print media to a hard copy producing mechanism located downstream of the deskew system along a print media transport path, the system comprising:

a guide supporting a print medium, the guide including a base member having support surface supporting a first surface of the print medium transported through the system, and adjacent the support surface, at least one abutment for abutting an edge of the print medium transported through the system and for aligning the print medium to the hard copy producing mechanism, and at least two apertures through the support surface; and located proximate the base member, a print medium feeder for transporting the print medium through the system, the feeder including, located respectively to bridge each of the at least two apertures, at least two paired spherical members for sequentially receiving the print medium by a leading edge between each of the paired spherical members and simultaneously driving the print medium along the transport path across the support surface and driving the print medium laterally to the transport path across the support surface such that the edge of the print medium is driven against the abutment, wherein each set of paired spherical members including a pinch sphere located superjacent one of the apertures and a drive sphere located subjacent one of the apertures such that the pinch sphere and drive sphere of a set are in peripheral contact at a predetermined pressure for receiving and driving the print medium there between;

a transport path drive motor having a first drive shaft coupled to each drive sphere of each set of paired spherical members for simultaneously imparting motion to each the drive sphere to impart a drive force longitudinally in the transport path; and a deskew drive motor having a second drive shaft coupled to each drive sphere of each set of paired spherical members for simultaneously imparting motion to each the drive sphere to impart a drive laterally to the transport path.

13. The system as set forth in claim 12, the feeder further comprising:

means for adjusting lateral forces exerted on the print medium.

14. The system as set forth in claim 12, comprising:

the at least two apertures are offset in the a transport path axis.

15. The system as set forth in claim 12, comprising:

the at least two apertures are axially aligned with the transport path.

16. The system as set forth in claim 12, comprising:

a grid of paired spherical members arrayed respectively with respect to a plurality of apertures in the support surface such that the grid has a predetermined pattern associated with a plurality of sizes of print media transported by the system.

17. The system as set forth in claim 12, comprising:

the predetermined pressure is a function of a first coefficient of friction between each pinch sphere and drive sphere respectively wherein the first coefficient is less than a second coefficient of friction between each drive sphere and the print medium respectively such that the drive sphere will slip when a print medium edge hits the abutment, but not so low as not to overcome the print medium friction with the support surface.

18. The system as set forth in claim 12, comprising:

the first shaft is coupled to each drive sphere via a transmission sphere fixedly mounted on the first shaft and peripherally in contact with each drive sphere.

19. The system as set forth in claim 17, comprising:

the second drive shaft is coupled to each drive sphere via an adjacently located lateral positioning drive spheres slip mounted on the second drive shaft and respectively peripherally in contact with each drive sphere such that lateral positioning force is imparted to each the drive sphere at any pressure less than the predetermined back pressure which will cause the contact to slip.

20. The system as set forth in claim 19, the means for adjusting lateral forces comprising:

means for exerting a lateral force on the second drive shaft in the direction of the abutment, and means for adjusting the lateral force such that the lateral force serves to bias the side edge of a sheet in the paper path on the plate surface at selective levels associated with predetermined media thicknesses.

21. The system set forth in claim 20, the means for adjusting lateral forces comprising:

a camming device for setting a lateral pressure against the second drive shaft such that selectively changing the lateral pressure against the second drive shaft imparts variable lateral pressure to the lateral positioning drive spheres.

22. A print media deskew system for aligning print media to a hard copy producing mechanism located downstream of the deskew system along a print media transport path, the system comprising:

a guide for supporting a print medium, including a base member having support surface supporting a first surface of the print medium transported through the system, and adjacent the support surface, at least one abutment for abutting an edge of the print medium transported through the system and for aligning the print medium to the hard copy producing mechanism, and at least two apertures through the support surface;

located proximate the base member, a print medium feeder for transporting the print medium through the system, the feeder including, located respectively to bridge each of the at least two apertures, at least two paired spherical members for sequentially receiving the print medium by a leading edge between each of the paired spherical members and simultaneously driving the print medium along the transport path across the support surface and driving the print medium laterally to the transport path across the support surface such that the edge of the print medium is driven against the abutment, said feeder including means for adjusting lateral forces exerted on the print medium and wherein each set of paired spherical members including a pinch sphere located superjacent one of the apertures and a drive sphere located subjacent one of the apertures such that the pinch sphere and drive sphere of a set are in peripheral contact at a predetermined pressure for receiving and driving the print medium there between;

a transport path drive motor having a first drive shaft coupled to each drive sphere of each set of paired spherical members for simultaneously imparting motion to each the drive sphere to impart a drive force longitudinally in the transport path;

a deskew drive motor having a second drive shaft coupled to each drive sphere of each set of paired spherical members for simultaneously imparting motion to each the drive sphere to impart a drive laterally to the transport path; and the means for adjusting lateral forces including means for exerting a lateral force on the second drive shaft in the direction of the abutment, and means for adjusting the lateral force such that the lateral force serves to bias the side edge of a sheet in the paper path on the plate surface at selective levels associated with predetermined media thicknesses.

23. The system as set forth in claim 22, comprising:

the at least two apertures are offset in a transport path axis.

24. The system as set forth in claim 22, comprising:

the at least two apertures are axially aligned with the transport path.

25. The system as set forth in claim 22, comprising:

a grid of paired spherical members arrayed respectively with respect to a plurality of apertures in the support surface such that the grid has a predetermined pattern associated with a plurality of sizes of print media transported by the system.

26. The system as set forth in claim 22, comprising:

the predetermined pressure is a function of a first coefficient of friction between each pinch sphere and drive sphere respectively wherein the first coefficient is less than a second coefficient of friction between each drive sphere and the print medium respectively such that the drive sphere will slip when a print medium edge hits the abutment, but not so low as not to overcome the print medium friction with the support surface.

27. The system as set forth in claim 22, comprising:

the first shaft is coupled to each drive sphere via a transmission sphere fixedly mounted on the first shaft and peripherally in contact with each drive sphere.

28. The system as set forth in claim 27, comprising:

the second drive shaft is coupled to each drive sphere via an adjacently located lateral positioning drive spheres slip mounted on the second drive shaft and respectively peripherally in contact with each drive sphere such that lateral positioning force is imparted to each the drive sphere at any pressure less than the predetermined back pressure which will cause the contact to slip.

29. The system set forth in claim 28, the means for adjusting lateral forces comprising:

a camming device for setting a lateral pressure against the second drive shaft such that selectively changing the lateral pressure against the second drive shaft imparts variable lateral pressure to the lateral positioning drive spheres.

* * * * *

UNITED STATES PATENT AND TRADEMARK OFFICE

CERTIFICATE OF CORRECTION

PATENT NO. : 6,241,242 B1
DATED : June 5, 2001
INVENTOR(S) : Munro

It is certified that error appears in the above-identified patent and that said Letters Patent is hereby corrected as shown below:

Column 1,
Line 16, after "drive" delete "d" and insert therefor -- a --.
Line 36, delete "e.q." and insert therefor -- e.g. --.

Column 3,
Line 3, after "in" insert -- FIG. 1 --.
Line 14, delete "tho" and insert therefor -- the --.
Line 43, delete "pick-anid-feed" and insert therefor -- pick-and-feed --.

Column 4,
Line 16, delete "arid" and insert therefor -- and --.

Column 7,
Line 44, delete "plate surface" and insert therefor -- abuntment means --.

Column 9,
Line 3, delete "plate surface" and insert therefor -- abuntment means --.

Column 10,
Line 8, delete "plate surface" and insert therefor -- abuntment means --.

Signed and Sealed this

Eighteenth Day of June, 2002

*Attest:*

*Attesting Officer*

JAMES E. ROGAN
*Director of the United States Patent and Trademark Office*